US005752852A

United States Patent [19]

Onoda

[11] Patent Number: 5,752,852

[45] Date of Patent: May 19, 1998

[54] WATERPROOF CONNECTOR-MOUNTING CONSTRUCTION

[75] Inventor: Katsuhiko Onoda, Shizuoka, Japan

[73] Assignee: Yazaki Corporation, Tokyo, Japan

[21] Appl. No.: 755,908

[22] Filed: Nov. 25, 1996

[30] Foreign Application Priority Data

Nov. 24, 1995 [JP] Japan ..... 7-305870

[51] Int. Cl.[6] ..... H01R 13/73

[52] U.S. Cl. ..... 439/559

[58] Field of Search ..... 439/559, 556, 439/587, 589, 271

[56] References Cited

U.S. PATENT DOCUMENTS

| | | | |
|---|---|---|---|
| 3,398,391 | 8/1968 | Brishka | 439/559 |
| 3,904,264 | 9/1975 | Oertle | 439/587 |
| 4,519,662 | 5/1985 | Riley et al. | 439/271 |

FOREIGN PATENT DOCUMENTS

| | | | |
|---|---|---|---|
| 2726672 | 12/1978 | Germany | 439/559 |

*Primary Examiner*—Gary F. Paumen
*Assistant Examiner*—Tho Dac Ta
*Attorney, Agent, or Firm*—Sughrue, Mion, Zinn, Macpeak & Seas, PLLC

[57] ABSTRACT

A waterproof connector-mounting construction 70 includes a connector-mounting through hole 43 formed through a mounting member 41, a tapered portion 45 of a truncated-cone shape formed at the connector-mounting through hole 43, the tapered portion 45 increasing in diameter progressively toward an outer surface of the mounting member 41, a terminal 49 having a cylindrical base portion 57, a mounting plate 63 which is mounted on the terminal 49, and has at least such an area that the mounting plate 63 covers the tapered portion 45, the mounting plate 63 being parallel to the mounting member 41, and an O-ring 69 press-fitted into the tapered portion 45 in such a manner that an inner peripheral surface of the O-ring 69 is held in intimate contact with an exposed portion of the terminal, and that the O-ring 69 is pressed against the mounting plate 63.

3 Claims, 4 Drawing Sheets

WATERPROOF CONNECTOR-MOUNTING CONSTRUCTION

BACKGROUND OF THE INVENTION

1. Field of the Invention

This invention relates to a connector having a terminal mounted in a housing, in which a waterproof seal is formed between the terminal and the housing, and also a waterproof seal is formed between the housing and a mounting member on which the connector is mounted.

2. Related Art

There is known the type of connector adapted to be mounted directly on a mounting member such as a casing of a device. In some cases, such a connector of the directly-mounting type is required to have a waterproof effect. In the connector of the directly-mounting type, it is necessary to form a waterproof seal between the connector and the casing, and also to form a waterproof seal between a terminal and a housing so as to prevent water from intruding from a mating connector to the connector through a terminal.

One such conventional waterproof connector-mounting construction in which a waterproof sea: is formed between the connector and the casing, and also a waterproof seal is formed between the terminal and the housing, uses two O-rings, and this conventional waterproof connector-mounting construction will be described with reference to FIG. 6 which is a vertical cross-sectional view.

A connector-mounting through hole 3 is formed through a diecast casing 1 of an electrically-conductive material. A terminal receiving chamber 7 is formed in a housing 5 made of an insulating material, and a male terminal 9, for example, of the round pin-type, is mounted in the terminal receiving chamber 7, with a flange 11 retainingly engaged with an elastic retaining piece portion 13 in the terminal receiving chamber 7.

A peripheral groove 15 is formed in an outer peripheral surface of a base portion of the male terminal 9, and an inner O-ring 17 is received in the peripheral groove 15. An inner peripheral surface of the inner O-ring 17 is held in intimate contact with the bottom of the peripheral groove 15, and an outer peripheral surface of the inner O-ring 17 is held in intimate contact with an inner surface of the terminal receiving chamber 7. Thus, the inner O-ring 17 forms a watertight seal between the terminal receiving chamber 7 and the male terminal 9. A peripheral groove 19 is formed in an outer peripheral surface of that portion of the housing 5 inserted into the connector-mounting through hole 3, and an outer O-ring 21 is received in the peripheral groove 19. An inner peripheral surface of the outer O-ring 21 is held in intimate contact with the bottom of the peripheral groove 19, and an outer peripheral surface of the outer O-ring 21 is held in intimate contact with an inner surface of the connector-mounting through hole 3. Thus, the outer O-ring 21 forms a watertight seal between the casing 1 and the housing 5.

In this waterproof connector-mounting construction, water, tending to intrude into the interior 23 of a device through a gap between the casing 1 and the housing 5, is blocked by the outer O-ring 21, and water, tending to intrude from a mating connector 25 into the interior 23 of the device through a gap between the housing 5 and the male terminal 9, is blocked by the inner O-ring 17.

Another conventional waterproof connector-mounting construction, in which the intrusion of water into the interior of a device is prevented, will be described with reference to FIG. 7. FIG. 7 is a cross-sectional view of the conventional waterproof connector-mounting construction of the resin-sealed type. In this conventional construction, an outer O-ring 21 forms a waterproof seal between a housing 27 and an inner surface of a connector-mounting through hole 3 as in the above-mentioned conventional construction. An annular space 31 is formed between the housing 27 and a male terminal 29, and for example, an epoxy resin 33 is filled in the space 31. Therefore, the male terminal 29 and the housing 27 are integrally connected together by the cured epoxy resin 33 in the space 31, and water, tending to intrude into the interior 23 of the device through a gap between the housing 27 and the male terminal 29, is blocked by the epoxy resin 33.

However, in the conventional construction shown in FIG. 6, the O-rings must be mounted on the) peripheries of the housing 5 and the male terminal 9, respectively, and since the two O-rings are thus required, the cost of the parts is increased. And besides, when mounting the O-rings, care must be taken so that the O-rings will not be damaged; otherwise the waterproof effect would be lowered, and when the number of the O-rings to be mounted increases, the efficiency of the operation is lowered.

In the conventional construction shown in FIG. 7, although the number of the O-ring is reduced, the epoxy resin 33 must be filled in the gap between the housing 27 and the male terminal 29, and this increases the production cost. And besides, the filling of the epoxy resin is troublesome, and the time for curing the epoxy resin is required, and therefore the efficiency of the operation is lowered.

SUMMARY OF THE INVENTION

The present invention has been made in view of the above problems, and an object of the invention is to provide a waterproof connector-mounting construction in which a waterproof effect is achieved by a single O-ring without the use of a resin seal, thereby achieving a reduced production cost and an enhanced assembling efficiency.

The above object has been achieved by a waterproof connector-mounting construction of the invention comprising:

- a connector-mounting through hole formed through a mounting member;
- a tapered portion of a truncated-cone shape formed at the connector-mounting through hole, the tapered portion increasing in diameter progressively toward an outer surface of the mounting member;
- a terminal having a cylindrical base portion;
- a mounting plate which is mounted on the terminal, and has at least such an area that the mounting plate covers the tapered portion, the mounting plate being parallel to the mounting member; and
- a seal ring press-fitted into the tapered portion in such a manner that an inner peripheral surface of the seal ring is held in intimate contact with an exposed portion of the terminal, and that the seal ring is pressed against the mounting plate.

In this waterproof connector-mounting construction, the connector, having the seal ring mounted on the exposed portion of the terminal, is inserted into the connector-mounting through hole, and the mounting plate is held against the outer surface of the mounting member, and therefore the seal ring is held against surfaces of the mounting plate, the tapered portion and the exposed portion of the terminal. Thus, the area between the mounting plate and the mounting member and the area between the mounting plate and the terminal are sealed in a waterproof manner at the same time by the single seal ring.

BRIEF DESCRIPTION OF THE DRAWINGS

FIG. 3(A) is a side-elevational view of the male terminal, and FIG. 3(B) is a front-elevational view of the male terminal.

DETAILED DESCRIPTION OF THE PREFERRED EMBODIMENTS

A preferred embodiment of a waterproof connector-mounting construction of the present invention will now be described in detail with reference to the drawings.

Figure 1:
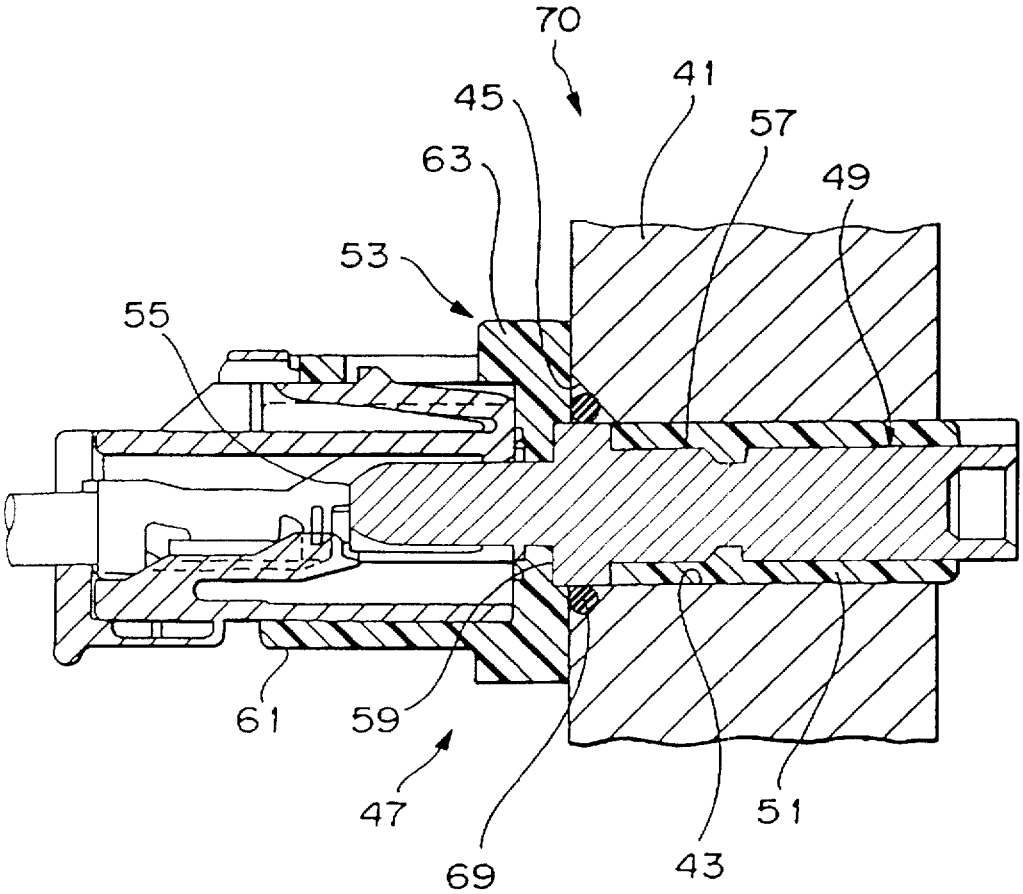
FIG. 1 is a cross-sectional view of a waterproof connector-mounting construction of the present invention.
Figure 2:
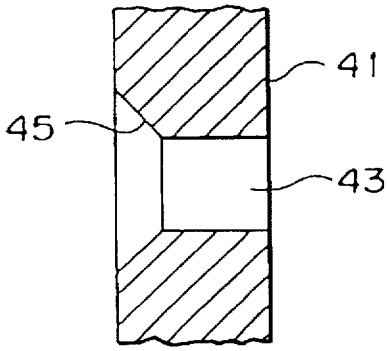
FIG. 2 is a cross-sectional view showing a connector-mounting through hole.
Figure 3A:
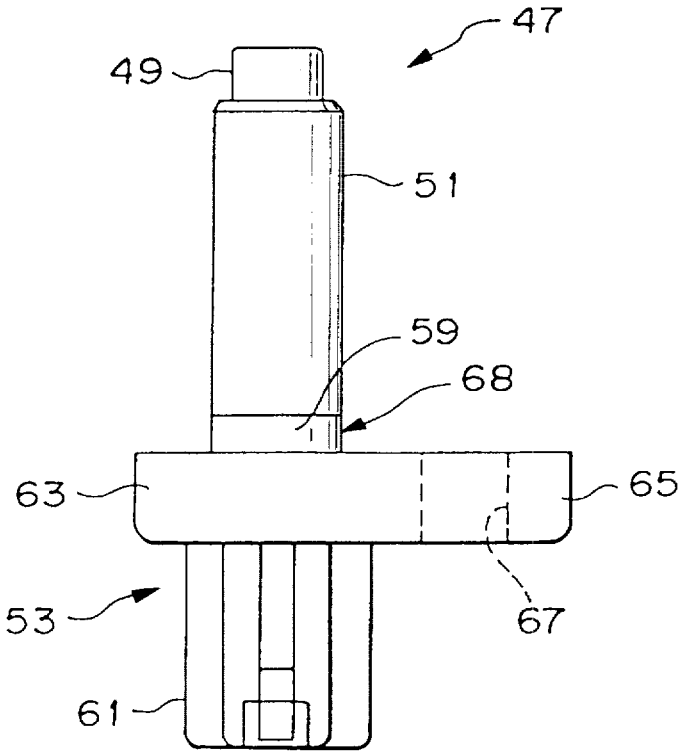
FIGS. 3(A) and 3(B) show the appearance of a male terminal.
Figure 3B:
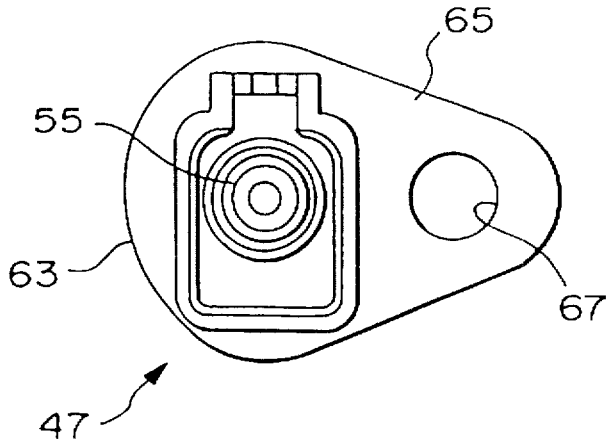
Figure 4:
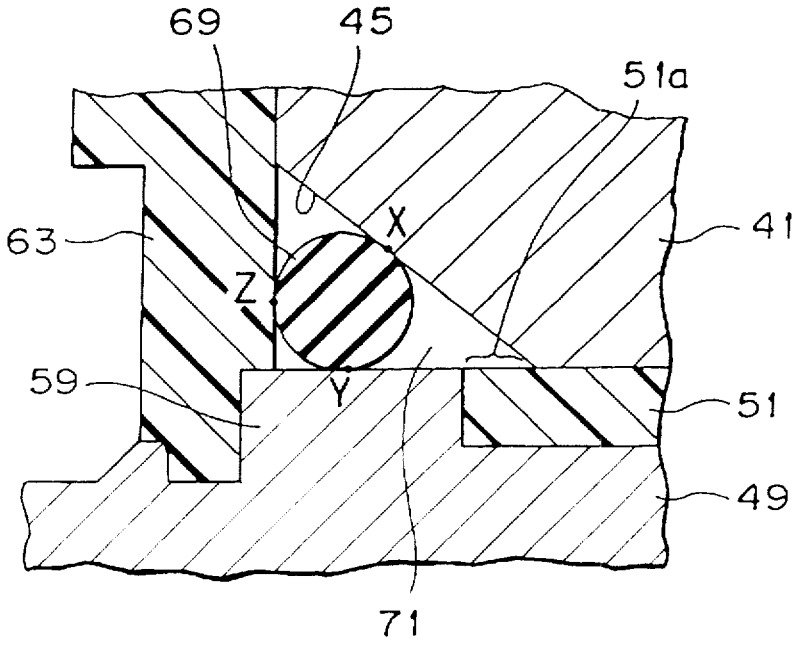
FIG. 4 is an enlarged view showing A seal ring-mounting portion.

FIG. 1 is a cross-sectional view of the waterproof connector-mounting construction of the invention, FIG. 2 is a cross-sectional view showing a connector-mounting through hole, and FIG. 3 shows the appearance of a male terminal, and FIG. 3(A) is a side-elevational view of the male terminal, and FIG. 3(B) is a front-elevational view of the male terminal. FIG. 4 is an enlarged view showing a seal ring-mounting portion. The connector-mounting through hole 43 is formed through a diecast mounting member 41 (such as a casing of a device; hereinafter referred to as "casing") of an electrically-conductive material. As shown in FIG. 2, one end portion of the connector-mounting through hole 43, which is open to the outer surface of the casing 41 facing away from the device, is formed into a tapered portion 45 of a truncated-cone shape which is increasing in diameter progressively toward the outer surface of the casing 41.

As shown in FIG. 3, a connector 47 to be inserted into the connector-mounting through hole 43 includes the terminal 49, a housing body 51, and a housing hood portion 53. An electric connection portion 55, for example, of a male round pin-type is formed at a distal end of the terminal 49. A base portion 57 of the terminal 49 has a cylindrical shape. A flange 59 is formed on the terminal 49 between the base portion 57 and the electric connection portion 55 over an entire periphery thereof, the flange 59 being larger in outer diameter than the base portion 57. An outer peripheral surface of the flange 59 is smooth, and is not rugged.

The hollow cylindrical housing body 51 is mounted on the outer periphery of the base portion 57. The base portion 57 and the housing body 51 are formed integrally with each other, for example, by insert molding. The outer diameter of the flange 59 is substantially equal to or slightly larger than the outer diameter of the housing body 51 mounted on the base portion 57.

The housing hood portion 53 is provided between the flange 59 and the electric connection portion 55 of the terminal 49. The housing hood portion 53 includes a hood 61 covering the electric connection portion 55 in surrounding relation thereto, and a mounting plate 63 connected to a distal end of the hood 61. A projected portion 65 extends from the mounting plate 63 in eccentric relation to the hood 61, and a hole 67 is formed through the projected portion 65. The terminal 49 and the housing hood portion 53 are formed integrally with each other, for example, by insert molding. Therefore, in the connector 47 of this construction, the flange 59 is held between the mounting plate 63 and the housing body 51, and the outer peripheral surface of the flange 59 is exposed as a terminal exposure portion 68 as shown in FIG. 3(A).

The outer diameter of the housing body 51 is substantially equal to or slightly smaller than the inner diameter of the connector-mounting through hole 43 so that the housing body 51 can be inserted into the connector-mounting through hole 43. When the mounting plate 63 is held against the outer surface of the casing 41, one end 51*a* of the housing body 51 is disposed in the tapered portion 45 as shown in FIG. 4. Namely, an insulating spacing is secured between the flange 59 and the tapered portion 45.

An O-ring 69, serving as a seal ring, is mounted on the outer periphery of the flange 59. The O-ring 69 is made of an elastic material such as rubber, and has an annular shape, and has a circular transverse cross-section. An inner diameter of the O-ring 69 is slightly smaller than the outer diameter of the flange 59, and an outer diameter of the O-ring 69 is smaller than the diameter of the outer portion of the tapered portion 45.

The operation of this waterproof connector-mounting construction 70 will now be described.

The connector 47, having the O-ring 69 mounted on the flange 59, is inserted into the connector-mounting through hole 43 in the casing 41, with the housing body 51 first inserted into the through hole 43. When the mounting plate 63 is brought into engagement with the outer surface of the casing 41, the insertion of the connector 47 is completed. In this condition, a bolt (not shown), passing through the hole 67 formed through the projected portion 65, is threaded into the casing 41, thereby fixing the connector 47 to the casing 41.

When the mounting plate 63 is abutted against the outer surface of the casing 41, an annular space 71 of a triangular transverse cross-section is formed between the connector 47 and the casing 41, and more specifically is formed by surfaces of the tapered portion 45, flange 59 and mounting plate 63, as shown in FIG. 4. The O-ring 69, mounted on the outer periphery of the flange 59, is disposed within this annular space 71. The circular transverse cross-section of the O-ring 69 is larger in diameter than a circle inscribed in a triangle defining the transverse cross-section of the annular space 71.

Therefore, when the mounting plate 63 is abutted against the outer surface of the casing 41, the O-ring 69 is pressed against the surfaces of the tapered portion 45, flange 59 and mounting plate 63 at three points x, y and z as shown in FIG. 4. Therefore, a waterproof seal is formed between the housing (the mounting plate 63) and the casing 41 at the press-contact points x and z, and also a waterproof seal is formed between the housing (the mounting plate 63) and the terminal 49 at the press-contact points y and z. Thus, the two sealing areas are sealed at the same time by one O-ring 69.

In the waterproof connector-mounting construction 70 of this embodiment, the area between the casing 41 and the insulating material (the housing body 51) and the area between the insulating material (the housing body 51) and the terminal 49 are both present in one annular space 71 at the outer periphery of the flange 59, and the O-ring 69 is pressed into intimate contact with each of the inner surfaces of this annular space 71. Thus, these two sealing areas are also sealed at the same time by one O-ring 69.

In the above waterproof connector-mounting construction 70, the housing body 51 is mounted around the base portion 57 of the terminal 49, and the housing hood portion 53 separate from the housing body 51 is provided and the flange 59 is exposed between the housing hood portion 53 and the housing body 51, and the O-ring 69 is mounted on the flange 59, and the O-ring 69 is held in intimate contact with the tapered portion 45 formed in the casing 41. With this construction, the two areas (which require the waterproof sealing), provided respectively between the casing 41 and the housing and between the housing and the terminal 49, are incorporated in one annular space 71 of a triangular transverse cross-section, and as a result the only one O-ring is needed.

The end 51*a* of the housing body 51 is disposed in the annular space 71, that is, in the tapered portion 45, and therefore the insulating spacing is secured between the flange 59 and the casing 41, and therefore the casing 41 is insulated from the terminal 49 as in the conventional construction.

Figure 5:
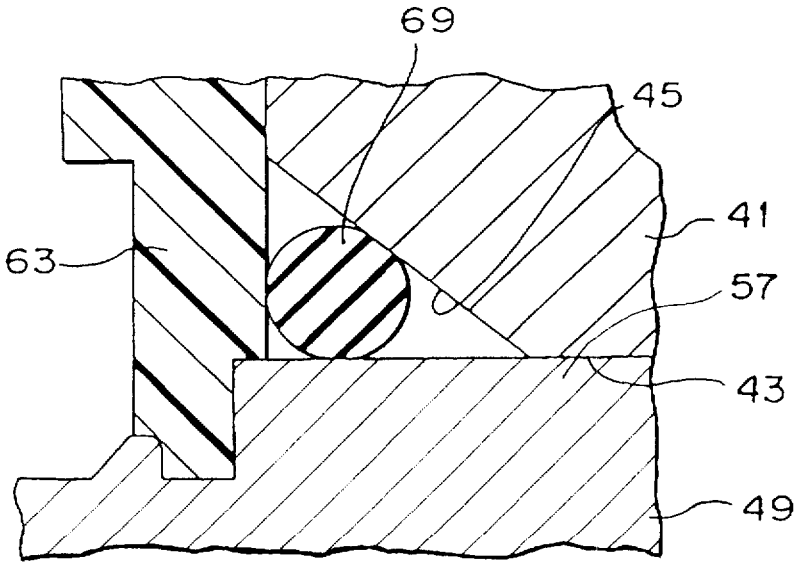
FIG. 5 is a cross-sectional view showing a modified waterproof connector-mounting construction of the invention.
Figure 6:
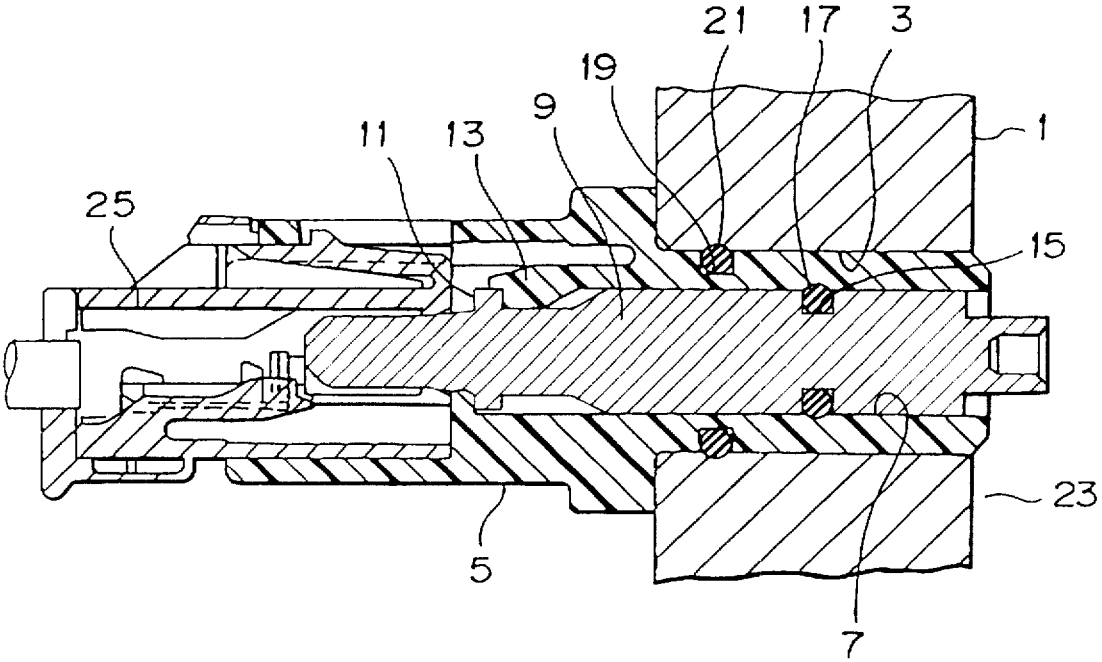
FIG. 6 PRIOR ART
FIG. 6 is a cross-sectional view of a conventional waterproof connector-mounting construction.
Figure 7:
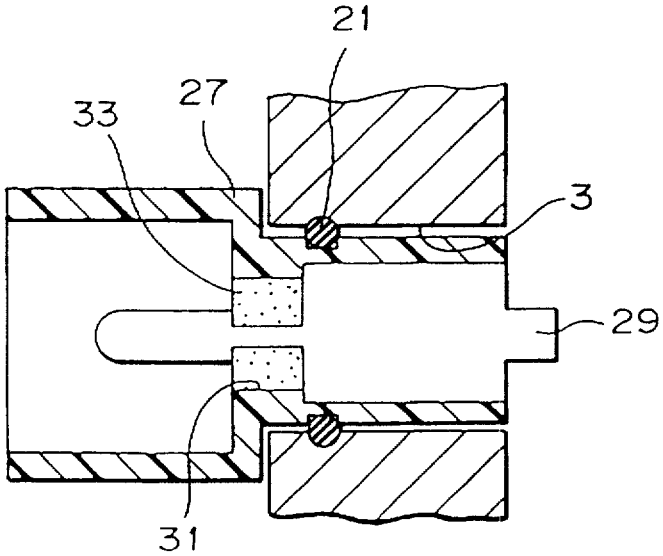
FIG. 7 PRIOR ART
FIG. 7 is a cross-sectional view of another conventional waterproof connector-mounting construction using a resin-sealed means.

In the above embodiment, the casing 41 is electrically conductive, but if the casing 41 is made of an insulating material, the construction can be made simpler. In this case, the housing body 51, which insulates the base portion 57 from the casing 41, does not need to be provided as shown in FIG. 5, and a base portion 57 of a terminal 49 can be inserted directly into the connector-mounting through hole 43.

In such a construction, also, the tapered portion 45 is formed at the connector-mounting through hole 45, and a mounting plate 63 is mounted on the terminal 49. In this construction, when the mounting plate 63 is fixed to the casing 41, the area between the housing (the mounting plate 63) and the casing 41 and the area between the housing (the mounting plate 63) and the terminal 49 are sealed in a waterproof manner by one O-ring 69, and the number of the component parts is reduced by saving the housing body 51, and therefore the construction can be made simpler.

In the above-mentioned waterproof connector-mounting construction 70, although the outer peripheral surface of the flange 59 is exposed as the terminal exposure surface 68, the outer peripheral surface of the base portion 57 of the terminal 49 may be directly exposed as a terminal exposure portion 68. In this case, it is not necessary to form the flange 59, and the formation or processing of the terminal 49 can be made easier.

As described in detail, in the waterproof connector-mounting construction of the invention, the tapered portion is formed at the connector-mounting through hole formed through the mounting member, and the housing, having the mounting plate, is mounted on the terminal, and the seal ring is mounted on the exposed portion of the terminal, and the mounting plate is mounted on the mounting member, so that the seal ring is held in intimate contact with the tapered portion through the mounting plate. Therefore, the two areas (which require the waterproof sealing), provided respectively between the mounting member and the housing and between the housing and the terminal, can be sealed in a waterproof manner by the single seal ring provided in the tapered portion. As a result, because of the reduced number of the component parts, the reduced production cost and the enhanced assembling efficiency can be achieved.

What is claimed is:

1. A waterproof connector-mounting construction comprising:

a connector-mounting through hole formed through a mounting member;

a tapered portion of a truncated-cone shape formed at said connector-mounting through hole, said tapered portion increasing in diameter progressively toward an outer surface of a said mounting member;

a terminal having a cylindrical base portion;

a mounting plate which is mounted on said terminal, and has at least such an area that said mounting plate covers said tapered portion, said mounting plate being parallel to said mounting member; and a seal ring press-fitted into said tapered portion in such a manner that an inner peripheral surface of said seal ring is held in intimate contact with an exposed portion of said terminal, and that said seal ring is pressed against said mounting plate.

2. A waterproof connector-mounting construction according to claim 1, in which said seal ring is an O-ring.

3. A waterproof connector-mounting construction according to claim 1, further comprising:

a hollow cylindrical housing body, made of an electrically-insulating material, mounted on said base portion of said terminal, and inserted in said connector-mounting through hole.

* * * * *